US006036473A

United States Patent [19]

Ichinose et al.

[11] Patent Number: 6,036,473

[45] Date of Patent: Mar. 14, 2000

[54] HEAVY OIL EMULSIFIED FUEL COMBUSTION APPARATUS

[75] Inventors: Toshimitsu Ichinose; Hirokazu Hino; Akira Yamada; Hiroshi Kikuchi; Katsuyuki Ueda, all of Nagasaki, Japan

[73] Assignee: Mitsubishi Heavy Industries, Ltd., Tokyo, Japan

[21] Appl. No.: 09/052,123

[22] Filed: Mar. 31, 1998

[30] Foreign Application Priority Data

Apr. 1, 1997 [JP] Japan ..... 9-082777

[51] Int. Cl.[7] ..... F23J 7/00; F23D 11/44; C10C 1/20; C07C 51/44; F15D 55/00

[52] U.S. Cl. ..... 431/4; 431/11; 431/12; 431/208; 431/211; 196/98; 196/46; 203/14; 138/40

[58] Field of Search ..... 431/4, 11, 12, 431/208, 211; 196/98, 46, 107; 203/14; 138/40

[56] References Cited

U.S. PATENT DOCUMENTS

| | | | |
|---|---|---|---|
| 2,316,383 | 4/1943 | Abercrombie | 138/40 |
| 2,426,110 | 8/1947 | McCorquodale, Jr. et al. | 196/98 |
| 3,645,298 | 2/1972 | Roberts et al. | 138/40 |
| 3,791,965 | 2/1974 | Fitzsimons et al. | 208/179 |
| 4,376,676 | 3/1983 | Gill | 196/46 |
| 4,814,044 | 3/1989 | Hitt | 196/98 |
| 4,995,495 | 2/1991 | Krynski | 196/46 |
| 5,707,510 | 1/1998 | Berry | 196/46 |
| 5,816,790 | 10/1998 | Ichinose et al. | 431/4 |

FOREIGN PATENT DOCUMENTS

| | | |
|---|---|---|
| 0044198A2 | 1/1982 | European Pat. Off. . |
| 0760451A2 | 3/1997 | European Pat. Off. . |

*Primary Examiner*—Ira S. Lazarus
*Assistant Examiner*—David Lee
*Attorney, Agent, or Firm*—Wenderoth, Lind & Ponack, L.L.P

[57] ABSTRACT

A heavy oil emulsified fuel combustion apparatus is provided in which steam bubbles generated in the pressure reduction operation for dewatering a heavy oil emulsified fuel before combustion are prevented from mixing into a dewatered heavy oil side resulting in lowering of a dewatering efficiency.

In a heavy oil emulsified fuel combustion boiler, a heavy oil emulsified fuel 101 is heated by a heater 110 and dewatered by a flusher 120 and then introduced into a boiler 10 for combustion, and water 152 obtained by the dewatering is sent to a water utilizing system of the boiler. The heavy oil emulsified fuel 102 is heated in a high pressure and then introduced into a pressure reducing device 200 to be applied by a pressure reduction by multi-stage orifices 201 for dewatering. The pressure reduction is done with a pressure reduction per stage of 1 to 3 ata.

12 Claims, 3 Drawing Sheets

HEAVY OIL EMULSIFIED FUEL COMBUSTION APPARATUS

BACKGROUND OF THE INVENTION

1. Field of the Invention

The present invention relates to a heavy oil emulsified fuel combustion apparatus of a heavy oil emulsified fuel combustion boiler and the like for a public utility or an industrial use.

2. Description of the Prior Art

FIG. 3 is a schematic diagram of a prior art heavy oil emulsified fuel combustion boiler. In the boiler shown in FIG. 3, a heavy oil emulsified fuel 101 is directly supplied to a burner of a boiler 10 from a fuel tank 100. An atomizing steam 9 for the heavy oil emulsified fuel 101 is also supplied to the burner so that the heavy oil emulsified fuel 101 is atomized to combustible particle sizes.

Then, the fuel 101 is burnt in the boiler 10. On the other hand, in order to blow off the ash content, etc., sticking to heat exchanger tubes, etc., in the boiler 10, other steam 8 is supplied into the boiler 10. A waste gas 11 generated by combustion in the boiler 10 flows through a denitration apparatus 20, a dust removal apparatus 30 and a desulfurization apparatus 40 and is discharged into the air from a stack 50.

In the prior art, the heavy oil emulsified fuel 101 is supplied to the boiler 10 at an ordinary temperature, but because there is approximately 20 to 30% water contained in the heavy oil emulsified fuel 101, heat is required for vaporizing the water in the boiler 10, with the result that the boiler efficiency is lowered.

In the prior art heavy oil emulsified fuel combustion boiler as aforementioned, the boiler efficiency lowers due to a large amount of water contained in the heavy oil emulsified fuel. Because a large amount of water is contained in the boiler waste gas, a sulfuric acid dew point is elevated, and thus there is a problem of corrosion generating at, and soot and dust sticking to, downstream equipment. This in turn results in a problem of an increase of the water amount used for a soot blowing, etc. for removing the sticking dust.

Also, there is a problem in that a combustion gas amount increases due to steam generated by the combustion of the heavy oil emulsified fuel, which results in the enlargement of the downstream equipment.

Accordingly, in order to solve these problems, as aforementioned, in the heavy oil emulsified fuel combustion apparatus, i.e. to preventing the combustion efficiency from lowering due to the water content in the fuel and by preventing the sulfuric acid dew point from elevating due to water content in the combustion waste gas, the inventors here have heretofore disclosed a heavy oil emulsified fuel combustion apparatus in which the heavy oil emulsified fuel is burnt after the water content thereof is removed.

In a dewatering operation of the heavy oil emulsified fuel, a pressure reduction is done from a high pressure to an ordinary pressure of the heavy oil emulsified fuel which is pressurized and heated, and in this pressure reduction, a large number of steam bubbles arises. Unless these bubbles are eliminated, they mix into the dewatered emulsified fuel side, so that they are condensed to become water when the heavy oil emulsified fuel has been cooled down, with the result that the dewatering efficiency is lowered.

Thus, it is necessary to eliminate the large number of steam bubbles which arise when the pressure reduction is done from the high pressure to the ordinary pressure in the dewatering operation of the heavy oil emulsified fuel and to separate the steam to a separated steam side.

SUMMARY OF THE INVENTION

It is therefore an object of the present invention to provide a heavy oil emulsified fuel combustion apparatus in which steam bubbles arising at the time of pressure reduction in a dewatering operation of a heavy oil emulsified fuel before combustion can be prevented from mixing into a dewatered heavy oil side so as not to lower the dewatering efficiency.

In order to attain the object, the present invention provides a heavy oil emulsified fuel combustion apparatus in which a heavy oil emulsified fuel is heated and dewatered and then introduced into a combustion furnace for combustion and water so dewatered is supplied to a water utilizing system of the combustion furnace. There is provided a means for heating the heavy oil emulsified fuel under a high pressure and then dewatering it by pressure reduction in multi-stage. The pressure reduction is done with a pressure reduction per stage of 1 to 3 atm.

In the heavy oil emulsified fuel combustion apparatus of the present invention, the pressure reduction in multi-stages of the heavy oil emulsified fuel so heated in a high pressure may be done by use of a pressure reducing device having multi-stage orifices or multi-stage valves.

The reason for the pressure reduction to be done with a pressure reduction per stage of 1 to 3 atm in the heavy oil emulsified fuel combustion apparatus of the present invention is that if the pressure reduction per stage exceeds 3 atm, a large number of bubbles arise due to the pressure reduction. If these bubbles enter a downstream flusher tank, the level control of the tank becomes difficult and a pressure imbalance etc. arises resulting in an operational stop. If the pressure reduction is less than 1 atm, an increase of the number of pressure reduction stage becomes necessary.

According to the heavy oil emulsified fuel combustion apparatus of the present invention, the heavy oil emulsified fuel can be dewatered with a high dewatering efficiency and used for combustion. Hence a combustion of heavy oil emulsified fuel which is free from shortcomings seen in the prior art heavy oil emulsified fuel combustion apparatus becomes possible.

DESCRIPTION OF THE PREFERRED EMBODIMENTS

Figure 1:
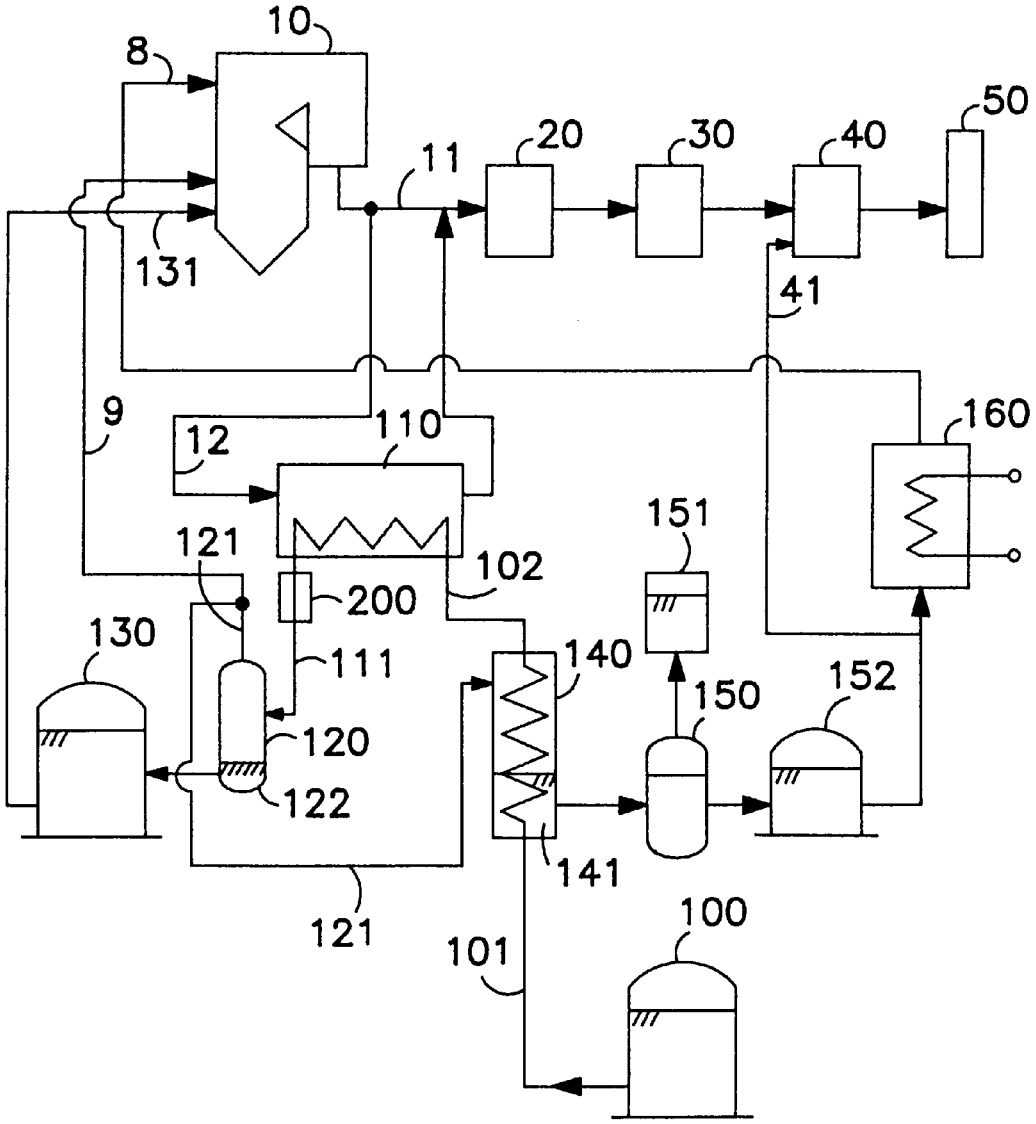
FIG. 1 is a schematic diagram of a heavy oil emulsified combustion boiler of one embodiment according to the present invention.
Figure 2:
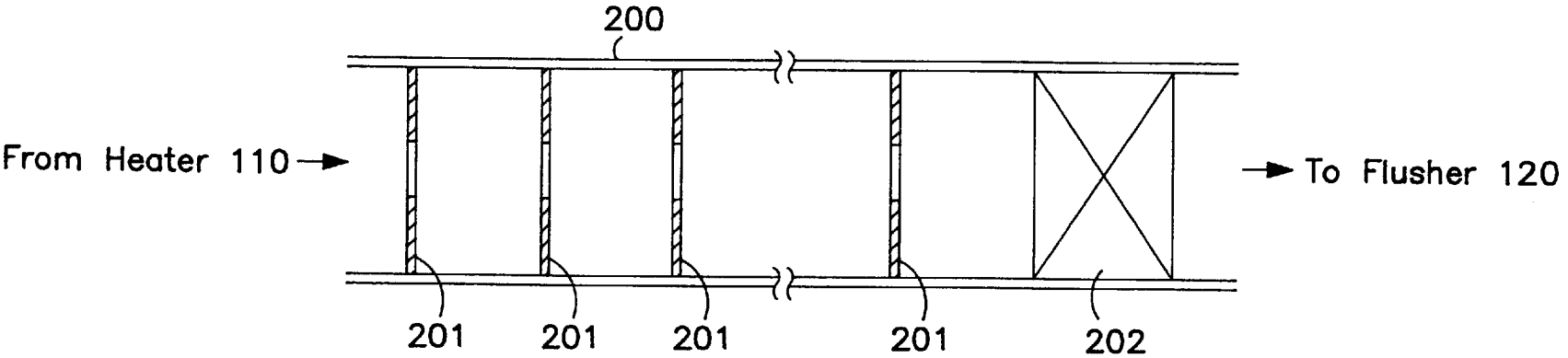
FIG. 2 is a cross sectional view of a pressure reducing device used in a heavy oil emulsified fuel combustion apparatus of the one embodiment according to the present invention.
Figure 3:
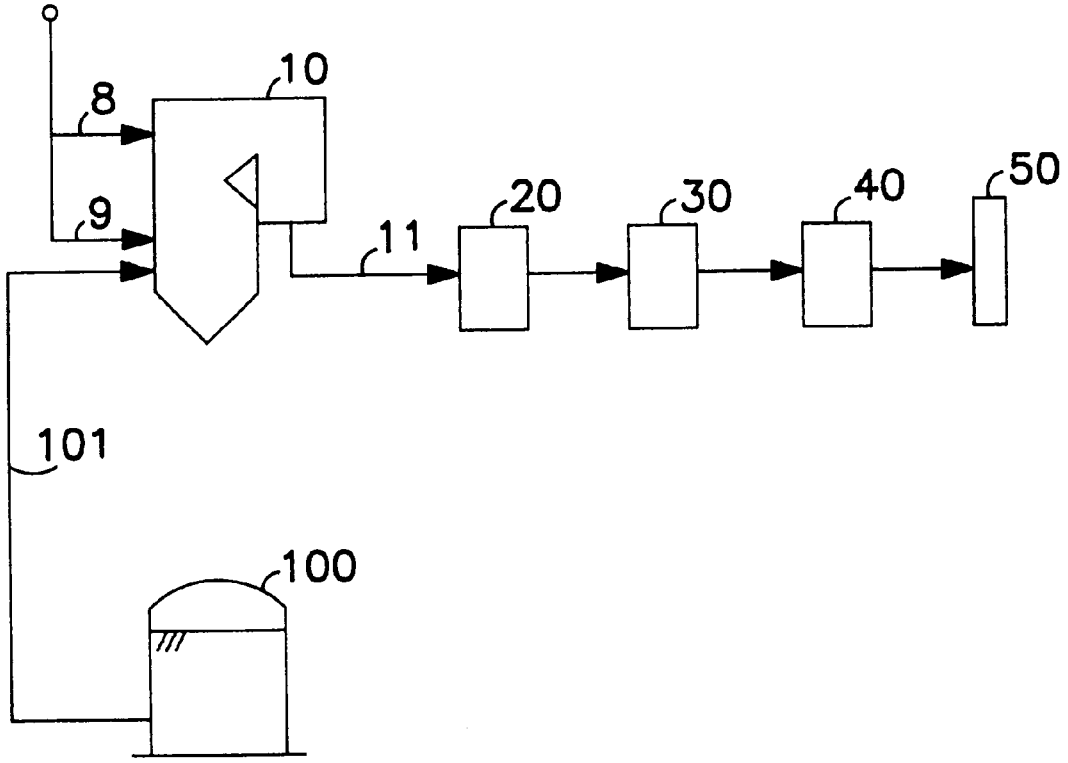
FIG. 3 PRIOR ART
FIG. 3 is a schematic diagram of a prior art heavy oil emulsified fuel combustion boiler.

Herebelow, description will be made of one embodiment shown in FIGS. 1 and 2 of a heavy oil emulsified fuel combustion apparatus according to the present invention. A heavy oil emulsified fuel combustion apparatus shown in FIG. 1 comprises two systems therein, one being a fuel supply system for a heavy oil emulsified fuel burning boiler consisting of a boiler 10 and a waste gas treatment system of a denitration apparatus 20, a dust removal apparatus 30, a wet type desulfurization apparatus 40, a stack 50, etc., and the other being a dewatering system for a heavy oil emulsified fuel, which consists of the following.

That is, the dewatering system consists of a heavy oil emulsified fuel tank 100, a heavy oil emulsified fuel heater 110, a flusher 120, a dewatered fuel storage tank 130, a dewatered steam condenser 140, an oily water separator 150, a water reheater 160, etc.

The dewatering system is further described. That is, the fuel sent from a heavy oil emulsified fuel production source is first stored in the fuel tank 100. The heavy oil emulsified fuel 101 sent from the fuel tank 100 via a pump absorbs latent heat of steam 121 at the condenser 140, described later, to be elevated in temperature.

The emulsified fuel 102 is further heated by the heater 110 to a temperature at which the water content in the heavy oil emulsified fuel 102 can be vaporized and then supplied to the flusher 120. As a heat source for the heater 110, the sensible heat of portional gas 12 of boiler waste gas 11 is made use of.

Fuel 111, heated by the heater 110 to a high temperature, is supplied into the flusher 120 to be separated into an oil content 122 of a heavy oil and a vapor 121 consisting of steam and a combustible gas of a light oil. The heavy oil content 122 is stored in the storage tank 130 and then supplied to a burner port of the boiler 10 as a boiler fuel 131. It is to be noted that because the heavy oil content 122 loses its flowability at ordinary temperature, the storage tank 130, piping to the burner port, etc. are to be heated so as to maintain the flowability.

A portion of the vapor 121 is used as a burner atomizing vapor 9 and the remainder is sent to the condenser 140 so that its latent heat is recovered. The heat is transferred to the heavy oil emulsified fuel 101 and the vapor 121 is condensed to become a liquid 141 in which water content and light oil content are mixed together.

In order to make a full use of the water content and the light oil content, in the same system, they are separated into oil content 151 and water content 152 by the oily water separator 150. The oil content 151 is used as fuel for an ignition torch etc. of the boiler, and the water content 152 is portionally used as cooling water 41 for the desulfurization apparatus 40 and portionally is heated by the reheater 160 to be used as steam 8 for soot blowing in the boiler, etc.

The steam 8 for soot blowing is indispensable in the boiler, and unless it is supplied from the water in the fuel as in the present invention, it would have to be supplied from other sources, With the present invention it can be supplied from the water in the fuel, and thus the water supplied to the boiler can be reduced remarkably and the efficiency of the boiler 10 and reliability of the downstream equipment can be greatly enhanced.

In the above, an operationes pressure of the heater 110 is as high as approximately 15 to 20 atm. In order to effect a pressure reduction to an ordinary pressure in the flusher 120, there is provided a pressure reducing device 200. One example of the pressure reducing device 200 is shown in FIG. 2. The pressure reducing device 200 is constructed such that a dewatered emulsion at an outlet of the heater 110 has a pressure reduction operation performed by multi-stage orifices 201. Incidentally, valves may be used for the pressure reduction in place of the orifices 201.

At an outlet portion, there is provided a pressure regulating valve 202 for fine regulation of the pressure. Further, the pressure reduction by the pressure reducing device 200 is to be done so that, while bubble generation accompanying the pressure reduction is suppressed with the pressure reductions per stage being set to 1 to 3 atm, the pressure reduction may be done with a lesser number of pressure reduction stages.

By use of the pressure reducing device 200 as so constructed, there are generated only a small number of bubbles in the pressure reduction of the heated heavy oil emulsified fuel and there is caused only a very small amount of water mixing into the dewatered emulsion side.

As described above, according to the heavy oil emulsified fuel combustion apparatus of the present invention, the construction is such that there are provided means for heating the heavy oil emulsified fuel at a high pressure and then dewatering it by the pressure reduction in multi-stages. The pressure reduction is done with a pressure reduction per stage being 1 to 3 atm, and thus there can be obtained a dewatered heavy oil emulsified fuel for combustion in which there is caused less generation of bubbles due to the pressure reduction and the water content is regulated to 2 to 5%.

In the heavy oil emulsified fuel combustion apparatus of the present invention, therefore, the water content in the heavy oil emulsified fuel to be supplied to the combustion apparatus can be reduced greatly. The combustion efficiency can thereby be enhanced and trouble accompanying an elevation of the sulfuric acid dew point of the downstream equipment, such as soot and dust sticking, accumulation, clogging, etc. can be dissolved, and an enhancement of the reliability can be attained.

It is understood that the invention is not limited to the particular construction and arrangement herein illustrated and described but embraces such modified forms thereof as come within the scope of the following claims.

What is claimed is:

1. A heavy oil emulsified fuel combustion apparatus, comprising:

a means for heating heavy oil emulsified fuel under pressure and for dewatering the heated and pressurized heavy oil emulsified fuel by pressure reduction through a plurality of stages, each of said stages reducing the pressure of the heavy oil emulsified fuel by 1 to 3 atm; and a combustion furnace for receiving the heavy oil emulsified fuel that has been heated and dewatered for combustion, said combustion furnace comprising a water utilization system connected to said means for heating and dewatering so that water that has been dewatered from the heavy oil emulsified fuel can be supplied to said water utilization system.

2. The heavy oil emulsified fuel combustion apparatus of claim 1, wherein said stages comprise respective orifices.

3. The heavy oil emulsified fuel combustion apparatus of claim 1, wherein said stages comprise respective valves.

4. The heavy oil emulsified fuel combustion apparatus of claim 2, wherein said plurality of stages further comprise a pressure regulating valve downstream thereof.

5. The heavy oil emulsified fuel combustion apparatus of claim 3, wherein said plurality of stages further comprise a pressure regulating valve downstream thereof.

6. The heavy oil emulsified fuel combustion apparatus of claim 1, wherein said means for heating heavy oil emulsified fuel under pressure heat the heavy oil at 15 to 20 atm.

7. A heavy oil emulsified fuel combustion apparatus, comprising:

a combustion furnace having a heavy oil emulsified fuel inlet; and a dewatering system connected to said heavy oil emulsified fuel inlet for supplying dewatered heavy oil emulsified fuel to said combustion furnace, said dewatering system comprising a heater for heating the heavy oil emulsified fuel under pressure, and a pressure reducing device connected with said heater downstream thereof for reducing the pressure of the heated heavy oil emulsified fuel, said pressure reducing device comprising a plurality of stages, and each of said stages being adapted to reduce the pressure of heavy oil emulsified fuel by 1 to 3 atm.

8. The apparatus of claim 7, wherein said dewatering system has a flusher connected to a downstream end of said pressure reducing device and a dewatered fuel storage tank connected between said flusher and said heavy oil emulsified fuel inlet.

9. The apparatus of claim 3, wherein said stages comprise respective orifices.

10. The apparatus of claim 7, wherein said stages comprise respective valves.

11. The apparatus of claim 9, wherein said plurality of stages further comprise a pressure regulating valve downstream thereof.

12. The apparatus of claim 10, wherein said plurality of stages further comprise a pressure regulating valve downstream thereof.

* * * * *